US009797162B2

(12) United States Patent
Maguire et al.

(10) Patent No.: US 9,797,162 B2
(45) Date of Patent: Oct. 24, 2017

(54) KEY RELEASE STUD

(71) Applicants: Cary Maguire, Chicago, IL (US); Christopher Kelliher, Weehoken, NJ (US); Daniel Greene, Chicago, IL (US); Nicholas Eccles, Chicago, IL (US)

(72) Inventors: Cary Maguire, Chicago, IL (US); Dickoy Rudduck, San Fransisco, CA (US); Christopher Kelliher, Weehoken, NJ (US); Daniel Greene, Chicago, IL (US); Nicholas Eccles, Chicago, IL (US)

(73) Assignee: Telezygology, Inc., Redwood City, CA (US)

( * ) Notice: Subject to any disclaimer, the term of this patent is extended or adjusted under 35 U.S.C. 154(b) by 0 days.

(21) Appl. No.: 14/582,472

(22) Filed: Dec. 24, 2014

(65) Prior Publication Data

US 2015/0114057 A1 Apr. 30, 2015

Related U.S. Application Data

(63) Continuation of application No. 13/264,397, filed as application No. PCT/US2010/030529 on Apr. 9, 2010, now abandoned.

(60) Provisional application No. 61/168,973, filed on Apr. 14, 2009.

(51) Int. Cl.

| | |
|---|---|
| ***E05B 47/00*** | (2006.01) |
| ***E05B 15/00*** | (2006.01) |
| *E05B 15/02* | (2006.01) |
| *E05B 51/00* | (2006.01) |

(52) U.S. Cl.
CPC ..... *E05B 15/00* (2013.01); *E05B 47/0009* (2013.01); *E05B 51/005* (2013.01); *E05B 2015/0235* (2013.01); *E05B 2047/0085* (2013.01); *Y10T 70/7486* (2015.04); *Y10T 70/7559* (2015.04)

(58) Field of Classification Search
CPC .... E05B 15/00; E05B 47/0009; E05B 51/005; E05B 2015/0235; E05B 2047/0085; Y10T 70/7559; Y10T 70/7486; Y10T 70/7102; Y10T 70/7107; Y10T 70/7136
USPC ..... 70/49, 277, 278.3, 278.7, 279.1, 283.1
See application file for complete search history.

(56) References Cited

U.S. PATENT DOCUMENTS

| | | | | |
|---|---|---|---|---|
| 1,000,946 | A * | 8/1911 | Reed | 70/64 |
| 1,991,825 | A * | 2/1935 | Strickland | 70/233 |
| 2,507,941 | A * | 5/1950 | Staley | 292/19 |
| 2,537,750 | A * | 1/1951 | Gretschel | 190/116 |
| 3,147,607 | A | 9/1964 | Calvano et al. | |
| 3,504,511 | A * | 4/1970 | Allen | 70/241 |
| 3,780,904 | A * | 12/1973 | Stanford | 220/316 |
| 5,090,222 | A * | 2/1992 | Imran | 70/63 |

(Continued)

FOREIGN PATENT DOCUMENTS

WO 2005/047714 * 5/2005

*Primary Examiner* — Lloyd Gall
(74) *Attorney, Agent, or Firm* — Kartsounes Law, LLC

(57) ABSTRACT

A locking assembly comprising a fastener having a locking stud having a locking cavity and an aperture for receiving the locking stud, a lock having material adapted to contract when activated and having jaws adapted to engage the locking cavity of the locking stud when received in the aperture, and an unlocking mechanism comprising rotating body having an opening for a key.

2 Claims, 6 Drawing Sheets

(56) References Cited

U.S. PATENT DOCUMENTS

| | | | | |
|---|---|---|---|---|
| 5,890,384 | A * | 4/1999 | Bartel et al. | 70/264 |
| 5,992,187 | A * | 11/1999 | Derman | 70/58 |
| 6,067,824 | A * | 5/2000 | Osborne | 70/252 |
| 6,363,763 | B1 * | 4/2002 | Geringer et al. | 70/432 |
| 2007/0204442 | A1 | 9/2007 | Falb et al. | |
| 2008/0127684 | A1 * | 6/2008 | Rudduck et al. | 70/77 |

* cited by examiner

KEY RELEASE STUD

FIELD OF THE INVENTION

This invention relates to a locking assembly. In particular, this invention relates to a locking assembly having a slip stud and manual key release.

BACKGROUND OF THE INVENTION

Many locking systems use fastener assemblies that comprise a mechanical or electro mechanical locking mechanisms. The lock generally consists of a mechanism which engages a male pin or staple when the door is closed. In the closed position the lock remains engaged to the male portion. While these types of systems have been successful in keeping items fastened, there are situation that can cause the fastener assembly some problems. Many times, there is a considerable amount of movement between the lock and item being secured which leads to alignment problems between the mechanism and the pin.

There is also the problem of debris, water, or other contaminants interfering with the locking motion of the fastener assembly. The fasteners are open to the elements and are prone to suffer damage due to these contaminants. As a result, a fastener may not fit together properly or as securely as it should or may not release as it is intended, causing problems for a user.

As such, a slip stud such as the one described in PCT/AU2006/001975 and incorporated herein by reference can be used to solve many of the abovementioned problems. However, there are times when a user wishes to manually release a slip stud and this invention aims to solve that problem.

SUMMARY OF THE INVENTION

This invention relates to a locking assembly having material adapted to contract when activated comprising a fastener having a locking stud having a locking cavity and an aperture for receiving the locking stud, a locking means having jaws adapted to engage the locking cavity of the locking stud when received in the aperture, and an unlocking means comprising rotating cylinder having an opening for a key.

One skilled in the art will recognize that the fastener may be any suitable fastener, including a fastener selected from the following patent specifications, each of which is incorporated herein by reference: WO 2005/047714, WO 2004/001235, WO 2005/090798, and WO 2006/105585. Especially preferred are the fasteners disclosed in the above specifications and referred to as radial or stud fasteners.

The material adapted to contract when activated is preferably shape memory alloy wire. Shape memory alloys are known and are usually made predominantly or wholly of titanium and nickel. They may also include other material, such as aluminium, zinc and copper. A shape memory alloy is capable of adopting one shape below a predetermined transition temperature and changing to a second shape once its temperature exceeds the transition temperature. Conversely, when the shape memory alloy cools below the transition temperature, it is capable of adopting the first shape again. In connection with the various aspects of the present invention, the shape memory alloy contracts when heated in situ. Shape memory alloy wire currently available, such as that sold under the name Nitinol, is capable of contracting by about 3% when activated by heating.

Activation of the material adapted to contract when activated is preferably achieved through electrical resistance heating, with a wire feed to the assembly. Activation of the shape memory alloy wire can be initiated from a central location, using the wiring system of, for example, an aircraft or automobile. It is also within the scope of this invention that the activation is initiated by remote means, such as a hand held tool operating through the use of any suitable form of energy, including microwave, electromagnetic, magnetic, sonic, infra-red, radio frequency and so on.

The scope of the invention is not necessarily limited to the use of shape memory alloy. Other material may also be useful. Also, while activation may take place through heating, other means of activation may be suitable and are within the scope of this invention.

In its locked position, the locking stud is held into the aperture by a locking means. The jaws hold the locking cavity of the locking stud firmly in the locked position. One skilled in the art will recognize that the jaws are spring loaded in its preferred embodiment. When a user desires to release the locking stud from the aperture, the user simply inserts a key into the key slot on the rotating body. The rotating body turns and spreads the jaws open. A spring can return the rotating body to its initial position so the key can be removed from the opening. Once the jaws are open, the locking stud is released from the aperture and the item that is locked by this locking assembly is now unlocked.

To lock the locking assembly, the stud simply re-enters the aperture by a user manually pushing the stud towards the aperture. The action causes the jaws to spread open and lock around the locking cavity.

To provide for situations where by the locking stud may not evenly match up to the aperture, the locking stud can float from the center position allowing for possible situations of misalignment. The locking assembly will lock and release anywhere within this window of floating.

A magnet can be added to the locking assembly. This magnet is to be positioned in the rotating cylinder and in a position so that movement of the magnet can sense the release of the locking stud.

One skilled in the art will recognize that this locking assembly can be a standalone assembly or can mount on an outer surface of an item to be locked. In situations where it is mounted on the outer surface, a user can mount only the rotating cylinder and a mounting plate on the outer surface for minimal exterior protrusion or a user can mount the entire locking assembly on the outer surface for minimal stud protrusion.

Other advantages and aspects of the present invention will become apparent upon reading the following description of the drawings and the detailed description of preferred embodiments of the invention.

DETAILED DESCRIPTION OF THE PREFERRED EMBODIMENT

Figure 1:
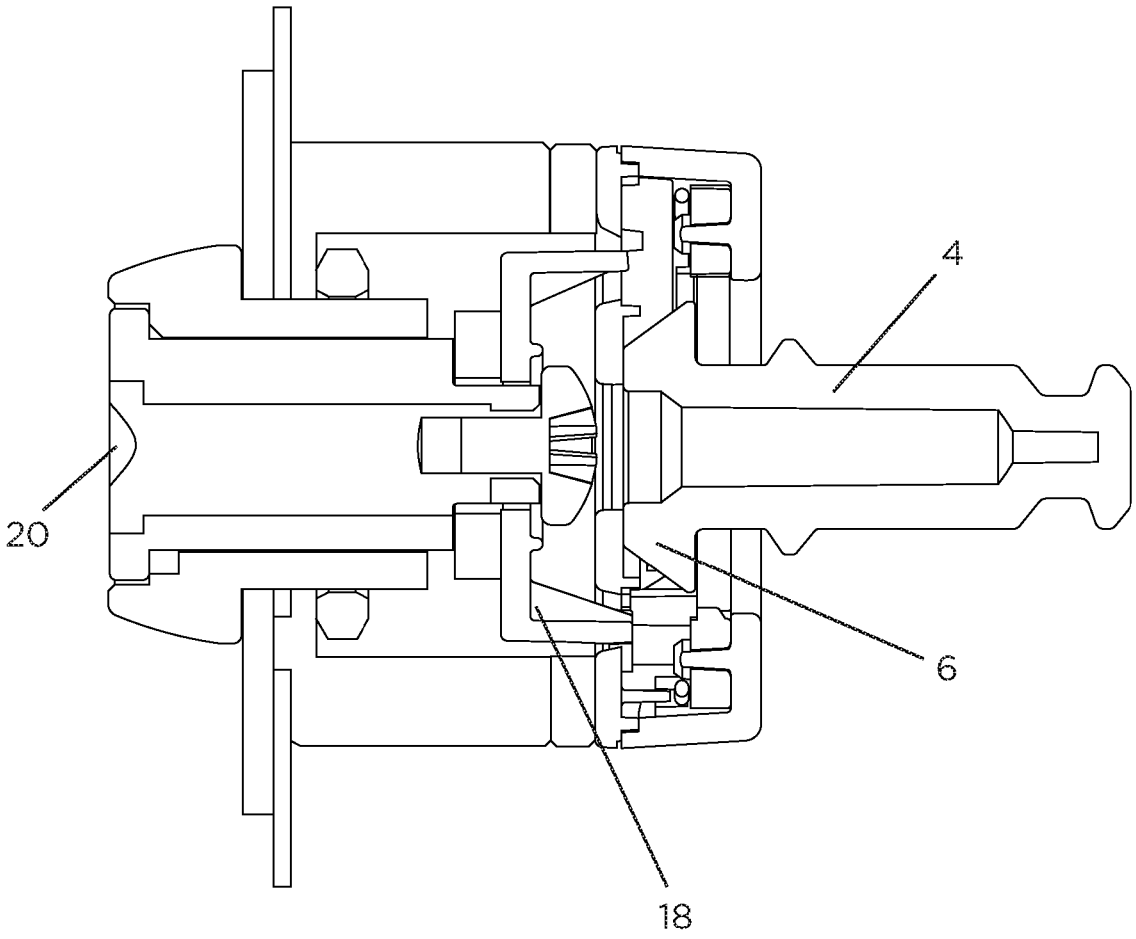
FIG. 1 depicts a cross-sectional view of the locking assembly.

The preferred embodiment of this locking assembly 2 having material adapted to contract when activated comprising a fastener having a locking stud 4 having a locking cavity 6 and an aperture 8 for receiving the locking stud, a locking means 16 comprising material adapted to contract when activated 14 and having jaws 12 adapted to engage the locking cavity 6 of the locking stud 4 when received in the aperture 8, and an unlocking means 24 comprising rotating body 18 having an opening for a key 20.

Figure 2A:
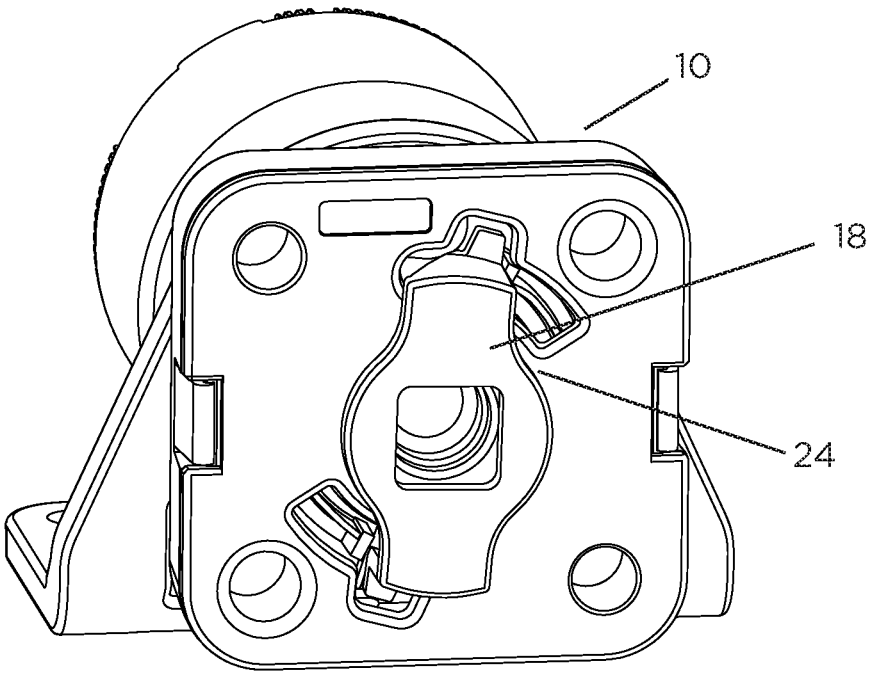
FIG. 2A depicts a view of the rotating cylinder in the closed position.
Figure 2B:
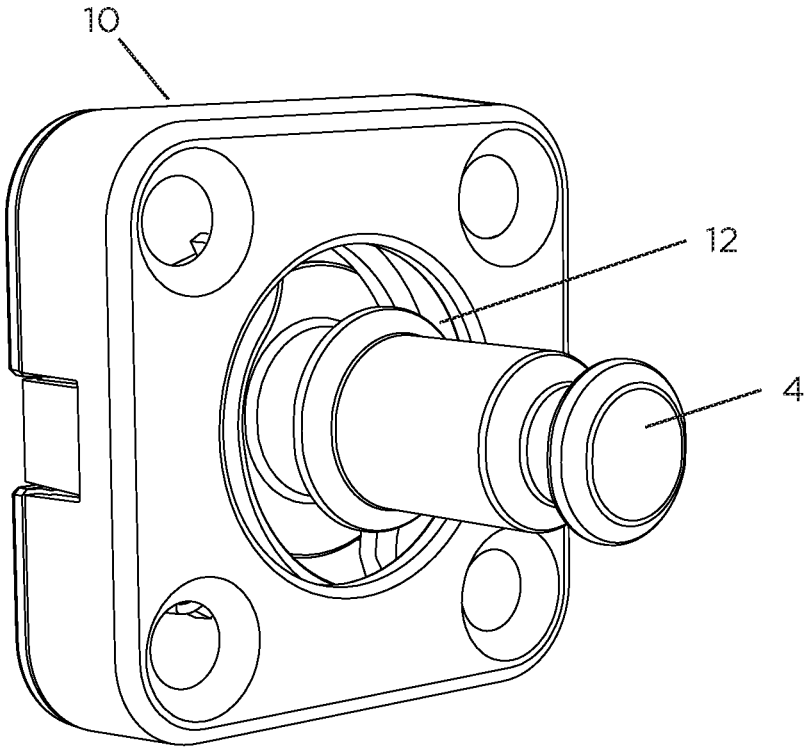
FIG. 2B depicts the locking stud in the closed position.

The aperture 8 is an opening in the housing 10. The housing 10 holds the locking means 16 and unlocking means 24. In its locked position, the locking stud 4 is firmly held into the aperture 8 by way of jaws 12 closing on the locking cavity 6. FIGS. 2A and 2B depict the locking assembly 2 in the locked position.

Figure 3A:
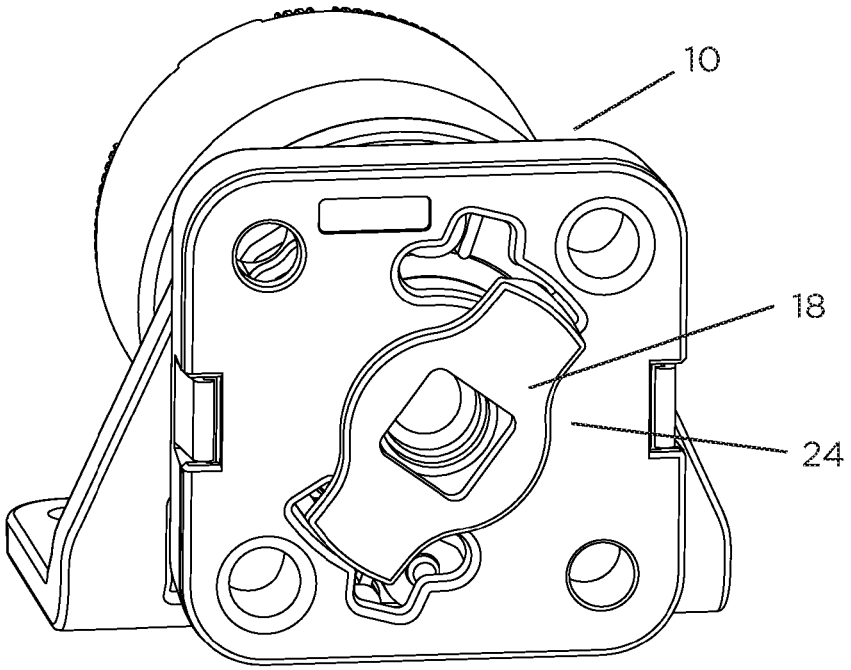
FIG. 3A depicts a view of the rotating cylinder in the open position.
Figure 3B:
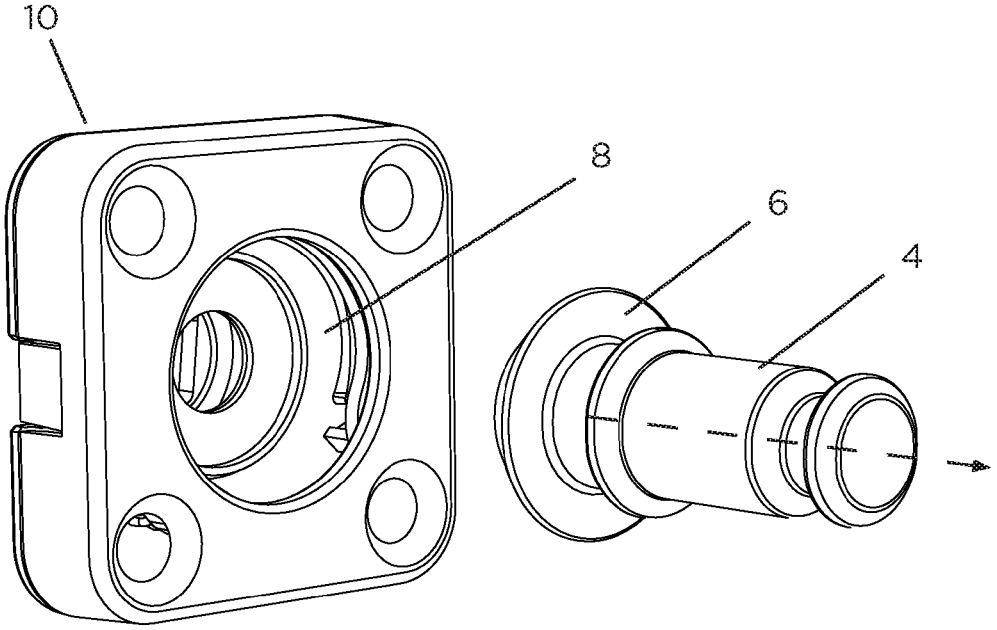
FIG. 3B depicts the locking stud in the open position.
Figure 4:
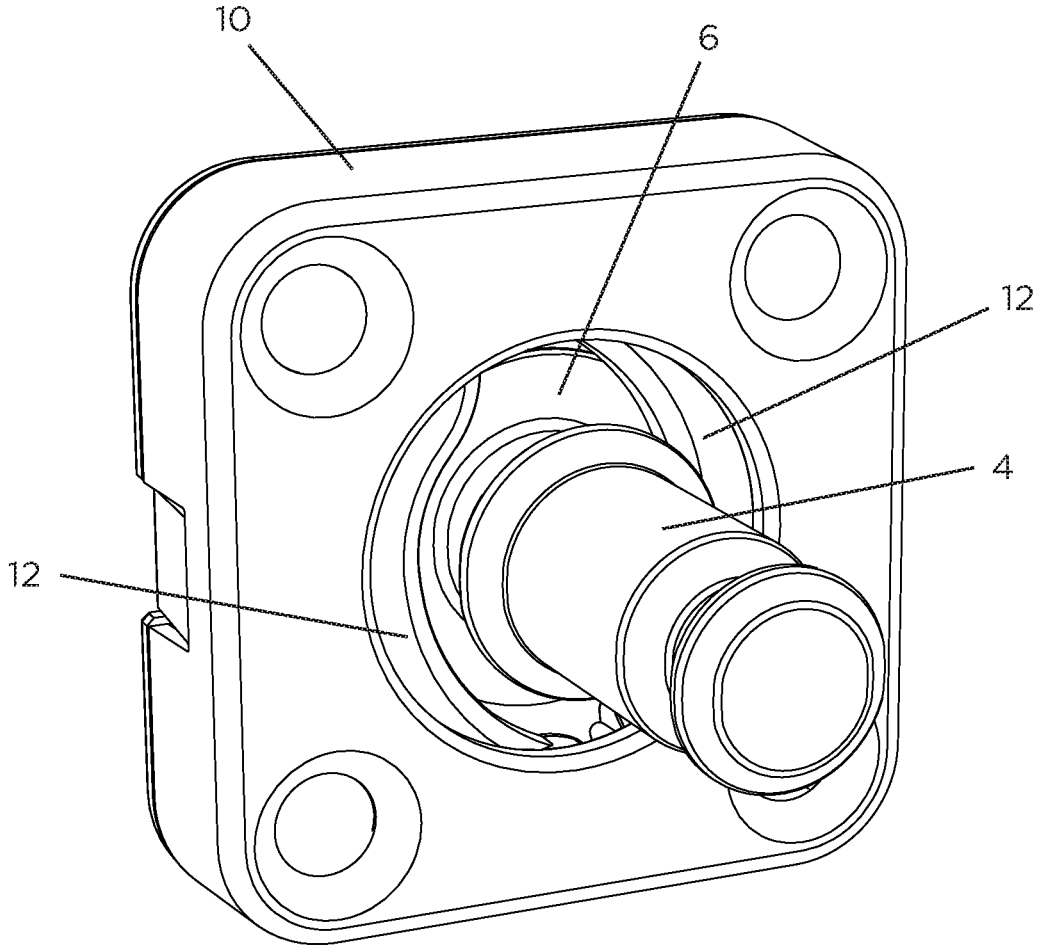
FIG. 4 depicts a view of the locking stud locked by the spring loaded jaws.
Figure 5:
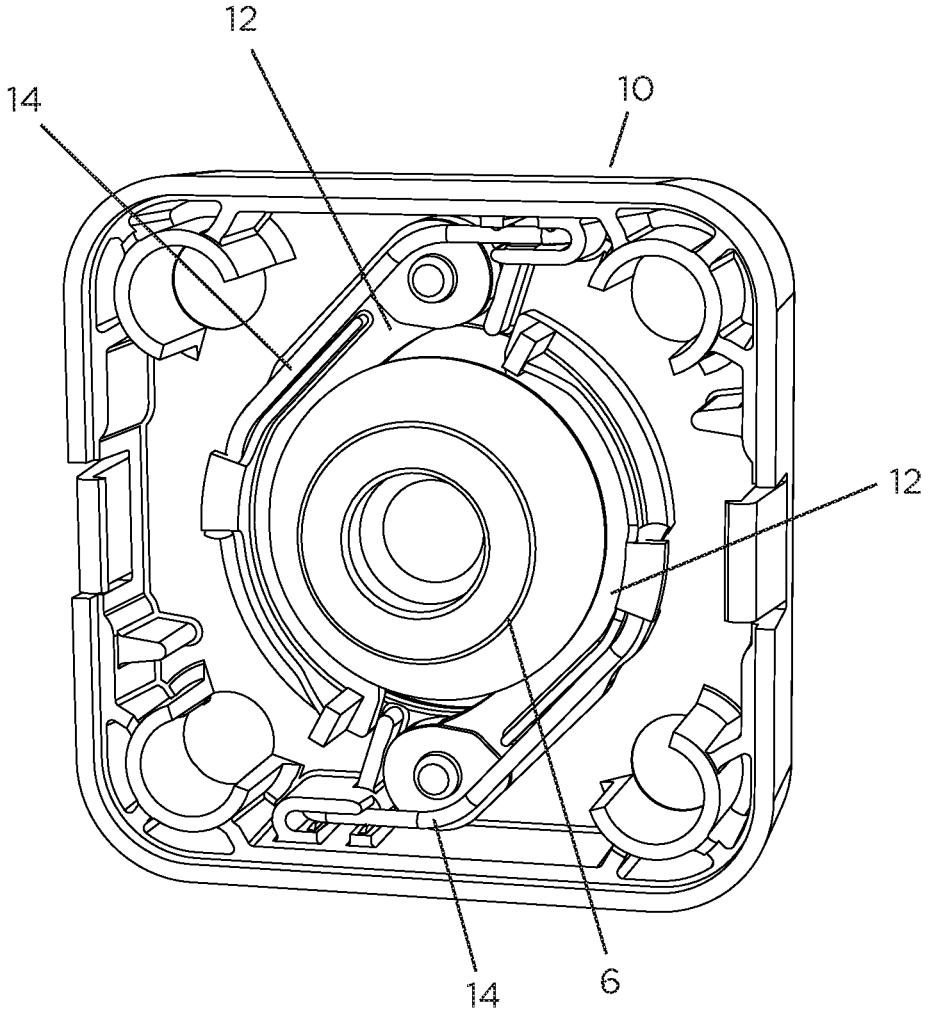
FIG. 5 depicts a view of the spring loaded jaws.
Figure 6:
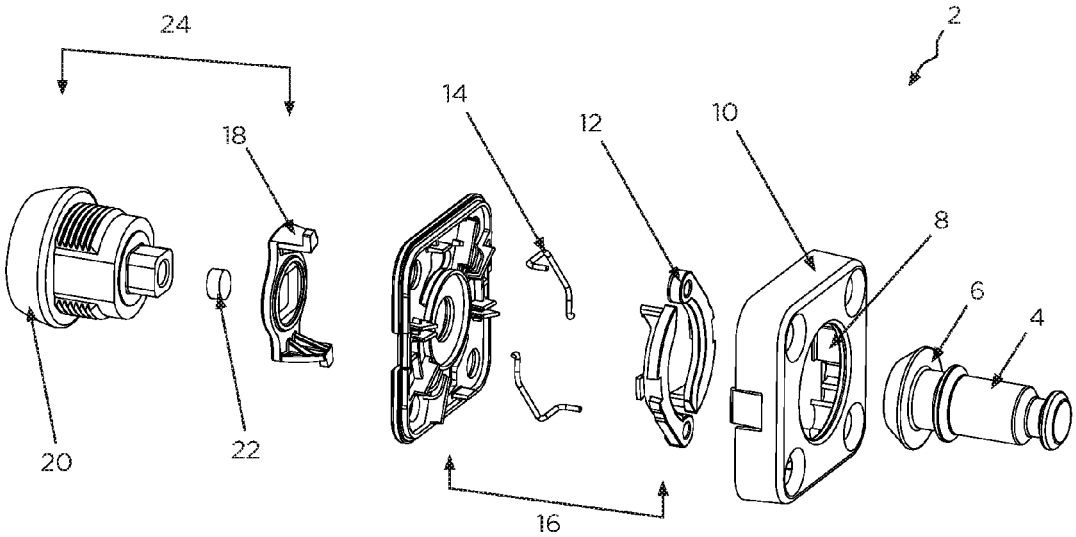
FIG. 6 depicts an exploded view of the locking assembly.

To release the locking stud 4 from the aperture 8, a user can insert a key (not pictured) into the opening for a key 20. When the user turns the key, the rotating body 18 rotates forcing the jaws 12 to spread. This action releases the locking stud 4 from the aperture 8 and the locking assembly 2 is unlocked. FIGS. 3A and 3B depict the locking assembly 2 in the unlocked position.

A magnet 22 can be added to the locking assembly 2 to assist in providing sensing capabilities. The motion of the magnet 22 will detect the release condition of the locking assembly 2.

It will be appreciated that changes may be made to the embodiments described herein without limiting the spirit and scope of the invention.

INDUSTRIAL APPLICABILITY

As will be readily appreciated by those skilled in the various arts, the invention disclosed herein is not limited to the examples set out and has wide applications in many areas, representing significant advances in the relevant art. In particular, the invention provides a release stud which is far more sophisticated compared to prior art.

The invention claimed is:

1. A locking assembly comprising:

a fastener having a locking stud, the locking stud having a locking cavity;

a housing having an aperture for receiving the locking stud;

a locking means having a pair of jaws adapted to engage the locking cavity of the locking stud when the locking stud is received in the aperture, each of the pair of jaws being pivotally mounted to the housing at spaced apart pivot points located diametrically opposed to each other with respect to the aperture of the housing, and configured for pivotal motion in a plane transverse to the axis of the locking stud;

a pair of shape memory alloy wire segments, each segment attached to a respective jaw of the pair of jaws and adapted to contract when heated to spread the pair of jaws to an open position; and an integral rotatable body rotatably mounted to the housing and concentrically positioned with respect to the aperture of the housing, the rotatable body having a pair of projecting arms, which extend from opposite sides of the rotatable body; and wherein the arms of the rotatable body are adapted to engage the jaws to forcibly spread the jaws toward the open position when the rotatable body is rotated.

2. The locking assembly of claim 1, wherein the locking cavity is a groove around the locking stud.

* * * * *